US011155771B2

(12) United States Patent
Sunder et al.

(10) Patent No.: US 11,155,771 B2
(45) Date of Patent: Oct. 26, 2021

(54) METHOD FOR PREPARING A LIQUID WASHING OR CLEANING AGENT USING A PRESERVATIVE-FREE DYE SOLUTION

(71) Applicant: Henkel AG & Co. KGaA, Duesseldorf (DE)

(72) Inventors: Matthias Sunder, Duesseldorf (DE); Uwe Trebbe, Duesseldorf (DE); Stefan Hammelstein, Duesseldorf (DE); Volker Blank, Leverkusen (DE); Thomas Holderbaum, Hilden (DE); Alexander Tollkoetter, Hilden (DE); Niklas Siepler, Duesseldorf (DE); Gerd Boesemann, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 16/186,172

(22) Filed: Nov. 9, 2018

(65) Prior Publication Data

US 2020/0148977 A1 May 14, 2020

(51) Int. Cl.
*C11D 3/40* (2006.01)
*C11D 3/43* (2006.01)

(52) U.S. Cl.
CPC . *C11D 3/40* (2013.01); *C11D 3/43* (2013.01)

(58) Field of Classification Search
CPC ..... C11D 3/42; C11D 3/43; C11D 3/40
See application file for complete search history.

(56) References Cited

U.S. PATENT DOCUMENTS

| | | | | |
|---|---|---|---|---|
| 3,158,615 | A | 11/1964 | Dunn et al. | |
| 4,500,321 | A | 2/1985 | Hugelshofer et al. | |
| 4,524,009 | A | 6/1985 | Valenty | |
| 4,639,325 | A | 1/1987 | Valenty et al. | |
| 5,137,646 | A * | 8/1992 | Schmidt ..... | C11D 3/505 510/101 |
| 2007/0191250 | A1 | 8/2007 | Lant | |
| 2012/0090102 | A1 | 4/2012 | Batchelor et al. | |
| 2016/0075977 | A1 | 3/2016 | Miracle et al. | |

FOREIGN PATENT DOCUMENTS

| | | | |
|---|---|---|---|
| DE | 2334899 | A1 | 1/1974 |
| DE | 3526405 | A1 | 2/1987 |
| DE | 4221381 | C1 | 2/1994 |
| DE | 4300772 | A1 | 7/1994 |
| DE | 4303320 | A1 | 8/1994 |
| DE | 4400024 | A1 | 7/1995 |
| DE | 4417734 | A1 | 11/1995 |
| DE | 19540086 | A1 | 4/1997 |
| DE | 19600018 | A1 | 7/1997 |
| DE | 102005024496 | A1 | 11/2006 |
| EP | 0026529 | A1 | 4/1981 |
| EP | 0150930 | A2 | 8/1985 |
| EP | 0164514 | A1 | 12/1985 |
| EP | 0232202 | A2 | 8/1987 |
| EP | 0280223 | A1 | 8/1988 |
| EP | 0427349 | A2 | 5/1991 |
| EP | 0472042 | A1 | 2/1992 |
| EP | 0542496 | A1 | 5/1993 |
| EP | 0703292 | A1 | 3/1996 |
| EP | 0727448 | A1 | 8/1996 |
| JP | H05339896 | A | 12/1993 |
| WO | 9218542 | A1 | 10/1992 |
| WO | 9308251 | A1 | 4/1993 |
| WO | 9316110 | A1 | 8/1993 |
| WO | 9428030 | A1 | 12/1994 |
| WO | 9507303 | A1 | 3/1995 |
| WO | 9512619 | A1 | 5/1995 |
| WO | 9520029 | A1 | 7/1995 |
| WO | 9520608 | A1 | 8/1995 |

OTHER PUBLICATIONS

European Patent Office, European Search Report, EP18176631, dated Nov. 13, 2018, pp. 1-7, Munich, Germany.

* cited by examiner

*Primary Examiner* — John R Hardee
(74) *Attorney, Agent, or Firm* — Thomas G. Krivulka

(57) ABSTRACT

A continuous method for preparing a liquid washing or cleaning agent which includes at least one surfactant and at least one dye. In this case, the dye solution used in the method according to the invention is free of preservatives. The present invention also relates to washing or cleaning agents which are obtained by way of the method according to the invention.

13 Claims, No Drawings

METHOD FOR PREPARING A LIQUID WASHING OR CLEANING AGENT USING A PRESERVATIVE-FREE DYE SOLUTION

FIELD OF THE INVENTION

The present invention relates to a continuous method for preparing a liquid washing or cleaning agent which comprises at least one surfactant and at least one dye. In this case, the dye solution used in the method according to the invention is free of preservatives. The present invention also relates to washing or cleaning agents which are obtained by means of the method according to the invention.

BACKGROUND OF THE INVENTION

Washing and cleaning agents are increasingly being prepared in continuous methods. In order to obtain a particular visual impression, a dye solution is usually also dosed into the preparation method. In order to prevent this dye solution from being contaminated, it has to be microbiologically stabilized.

Preservatives are being increasingly criticized and have been temporarily partially banned. There is therefore a need for dye solutions which do not contain preservatives, i.e. dye solutions which do not require microbiological preservation.

If non-preserved aqueous dye solutions are used to avoid preservatives, for reasons of production hygiene the solution should be replaced regularly, and the dosing line sanitized regularly using superheated steam. This leads to production stoppages. This also generates waste water which has to be disposed of, and this is therefore not only undesirable from a production engineering point of view, but also from an environmental aspect.

BRIEF SUMMARY OF THE INVENTION

There is therefore a need for a continuous method for preparing a liquid washing or cleaning agent in which preservative-free dye solutions can be used, and there is a need for a correspondingly preservative-free dye solution to be provided. Compared to the known aqueous dye solutions, these have to be designed such that the dosing line in the facility does not require regular sanitizing or has to be sanitized at least considerably less frequently. It has surprisingly been found that the problem addressed by the present invention can be solved by the dye solution being provided in a non-aqueous substance system.

In a first embodiment, the present invention therefore relates to a continuous method for preparing a liquid washing or cleaning agent comprising at least one surfactant and at least one dye, the method comprising the following steps:

a) providing a preservative-free dye solution, the dye first being dissolved in water and this premixture subsequently being diluted in a non-aqueous organic solvent, the content of the organic solvent being at least 70 wt. % based on the total weight of the dye solution,
b) dosing the dye solution obtained in this way into a surfactant-containing liquid flow.

In a further embodiment, the present invention relates to washing or cleaning agents which are obtained by means of the method according to the invention. The present invention also relates to preservative-free dye solutions, the dye first being dissolved in water and this premixture subsequently being diluted in a non-aqueous organic solvent, the content of the organic solvent being at least 70 wt. % based on the total weight of the dye solution.

These and other aspects, features, and advantages of the invention will become apparent to a person skilled in the art through the study of the following detailed description and claims. Any feature from one aspect of the invention can be used in any other aspect of the invention. Furthermore, it will readily be understood that the examples contained herein are intended to describe and illustrate but not to limit the invention and that, in particular, the invention is not limited to these examples.

Unless indicated otherwise, all percentages indicated are percent by weight and relate to the compositions mentioned in each case. Numerical ranges that are given in the format "from X to Y" include the cited values X and Y. If several preferred numerical ranges are indicated in this format, it is self-evident that all ranges that result from the combination of the various endpoints are also included.

"At least one", as used herein, also refers to one or more, for example 1, 2, 3, 4, 5, 6, 7, 8, 9 or more. In particular, this expression refers to the type of agent/compound and not to the absolute number of molecules.

"About" or "approximately", as used herein in connection with a numerical value, refers to the numerical value ±10%, preferably ±5%.

DETAILED DESCRIPTION OF THE INVENTION

It has surprisingly been found that the problems arising from the prior art are solved by the dye solution being prepared using a non-aqueous substance system. In this case, the dye is first dissolved in a small amount of water in order to dissolve said dye completely. The concentration of the dye in the aqueous premixture preferably corresponds to at least 400 times, more preferably at least 600 times, particularly preferably 800 times to 5,000 times, and in particular 900 times to 2,000 times, the target concentration of dye desired in the final product.

The premixture obtained in this way is then diluted using an organic, water-miscible solvent. This dilution is necessary to obtain a solution that can be continuously dosed with sufficient accuracy.

The dye solution obtained in this way, which comprises substantially organic solvents as solvents, is then dosed into a surfactant-containing liquid flow. Depending on the type of component also contained in the liquid flow, it may be necessary for the dye solution to be mixed with the surfactant-containing liquid flow by means of a mixer. In this case, the mixer can be a dynamic or static mixer.

It has surprisingly been found that a content of organic solvent of at least 70 wt. % in the dye solution ensures that microbiological preservation is not necessary. The content of an organic solvent is preferably at least 80 wt. % and more preferably at least 90 wt. %.

The dye is a conventional dye which can be used for various washing or cleaning agents. The dye is preferably selected from Acid Red 18 (CI 16255), Acid Red 26, Acid Red 27, Acid Red 33, Acid Red 51, Acid Red 87, Acid Red 88, Acid Red 92, Acid Red 95, Acid Red 249 (CI 18134), Acid Red 52 (CI 45100), Acid Violet 126, Acid Violet 48, Acid Violet 54, Acid Yellow 1, Acid Yellow 3 (CI 47005), Acid Yellow 11, Acid Yellow 23 (CI 19140), Acid Yellow 3, Direct Blue 199 (CI 74190), Direct Yellow 28 (CI 19555), Food Blue 2 (CI 42090), Food Blue 5:2 (CI 42051:2), Food Red 7 (CI 16255), Food Yellow 13 (CI 47005), Food Yellow 3 (CI 15985), Food Yellow 4 (CI 19140), Reactive Green 12 and Solvent Green 7 (CI 59040).

Particularly preferred dyes are water-soluble acid dyes, for example Food Yellow 13 (Acid Yellow 3, CI 47005), Food Yellow 4 (Acid Yellow 23, CI 19140), Food Red 7 (Acid Red 18, CI 16255), Food Blue 2 (Acid Blue 9, CI 42090), Food Blue 5 (Acid Blue 3, CI 42051), Acid Red 249 (CI 18134), Acid Red 52 (CI 45100), Acid Violet 126, Acid Violet 48, Acid Blue 80 (CI 61585), Acid Blue 182, Acid Blue 182, Acid Green 25 (CI 61570) and Acid Green 81.

Water-soluble direct dyes, for example Direct Yellow 28 (CI 19555) and Direct Blue 199 (CI 74190), and water-soluble reactive dyes, for example Reactive Green 12, and the dyes Food Yellow 3 (CI 15985) and Acid Yellow 184 are equally preferably used.

Aqueous dispersions of the following pigment dyes are equally preferably used: Pigment Black 7 (CI 77266), Pigment Blue 15 (CI 74160), Pigment Blue 15:1 (CI 74160), Pigment Blue 15:3 (CI 74160), Pigment Green 7 (CI 74260), Pigment Orange 5, Pigment Red 112 (CI 12370), Pigment Red 112 (CI 12370), Pigment Red 122 (CI 73915), Pigment Red 179 (CI 71130), Pigment Red 184 (CI 12487), Pigment Red 188 (CI 12467), Pigment Red 4 (CI 12085), Pigment Red 5 (CI 12490), Pigment Red 9, Pigment Violet 23 (CI 51319), Pigment Yellow 1 (CI 28 11680), Pigment Yellow 13 (CI 21100), Pigment Yellow 154, Pigment Yellow 3 (CI 11710), Pigment Yellow 74, Pigment Yellow 83 (CI 21108) and Pigment Yellow 97. In preferred embodiments, the following pigment dyes are used in the form of dispersions: Pigment Yellow 1 (CI 11680), Pigment Yellow 3 (CI 11710), Pigment Red 112 (CI 12370), Pigment Red 5 (CI 12490), Pigment Red 181 (CI 73360), Pigment Violet 23 (CI 51319), Pigment Blue 15:1 (CI 74160), Pigment Green 7 (CI 74260) and Pigment Black 7 (CI 77266).

In equally preferred embodiments, water-soluble polymer dyes are used, for example Liquitint, Liquitint Blue HP, Liquitint Blue MC, Liquitint Blue 65, Liquitint Cyan 15, Liquitint Patent Blue, Liquitint Violet 129, Liquitint Royal Blue, Liquitint Experimental Yellow 8949-43, Liquitint Green HMC, Liquitint Yellow LP, Liquitint Yellow II and mixtures thereof.

The use of water-soluble dyes is particularly preferred, the use of water-soluble polymer dyes being more particularly preferred.

The group of more particularly preferred dyes includes Acid Blue 3, Acid Yellow 23, Acid Red 33, Acid Violet 126, Liquitint Yellow LP, Liquitint Cyan 15, Liquitint Blue HP and Liquitint Blue MC.

The method according to the invention also comprises the dye solution being dosed in a surfactant-containing liquid flow. The liquid washing or cleaning agent obtained thus comprises at least one surfactant. The at least one surfactant can in this case be selected from anionic surfactants, non-ionic surfactants, cationic surfactants and zwitterionic surfactants. The washing or cleaning agent preferably comprises at least one anionic surfactant and/or at least one non-ionic surfactant.

Washing or cleaning agents which comprise at least one alkylbenzene sulfonate as an anionic surfactant are particularly suitable. The at least one alkylbenzene sulfonate is particularly preferably a linear or branched $C_{6-19}$ alkylbenzene sulfonate, preferably a linear $C_{9-13}$ alkylbenzene sulfonate.

Anionic surfactants that are used are those of the sulfonate and sulfate types, for example. Surfactants of the sulfonate type that can be used are preferably $C_{9-13}$ alkylbenzene sulfonates, olefin sulfonates, which is to say mixtures of alkene and hydroxyalkane sulfonates, and disulfonates, as obtained, for example, from $C_{12-18}$ monoolefins having a terminal or internal double bond by way of sulfonation with gaseous sulfur trioxide and subsequent alkaline or acid hydrolysis of the sulfonation products. Alkane sulfonates obtained from $C_{12-18}$ alkanes, for example by way of sulfochlorination or sulfoxidation with subsequent hydrolysis or neutralization, are also suitable. Likewise, the esters of α-sulfofatty acids (ester sulfonates) are suitable, for example the α-sulfonated methyl esters of hydrogenated coconut fatty acids, palm kernel fatty acids or tallow fatty acids.

Suitable alkylbenzene sulfonates are preferably selected from linear or branched alkylbenzene sulfonates of formula

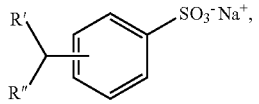

in which R' and R", independently of one another, are H or alkyl, and together contain 6 to 19, preferably 7 to 15, and in particular 9 to 13, C atoms. A more particularly preferred representative is sodium dodecylbenzene sulfonate.

The alkali salts, and in particular the sodium salts of the sulfuric acid half-esters of $C_{12}$-$C_{18}$ fatty alcohols, for example from coconut fatty alcohol, tallow fatty alcohol, lauryl alcohol, myristyl alcohol, cetyl alcohol or stearyl alcohol, or of $C_{10}$-$C_{20}$ oxo alcohols and the half-esters of secondary alcohols having this chain length are preferred as alk(en)yl sulfates. Alk(en)yl sulfates having the described chain length that include a synthetic straight-chain alkyl functional group prepared on a petrochemical basis, and have a degradation behavior similar to that of the adequate compounds based on fatty chemical raw materials, are also preferred. From a washing perspective, the $C_{12}$-$C_{16}$ alkyl sulfates, $C_{12}$-$C_{15}$ alkyl sulfates and $C_{14}$-$C_{15}$ alkyl sulfates are preferred.

The sulfuric acid monoesters of straight-chain or branched $C_{7-21}$ alcohols ethoxylated with 1 to 6 mol of ethylene oxide, such as 2-methyl-branched $C_{9-11}$ alcohols having, on average, 3.5 mol ethylene oxide (EO) or $C_{12-18}$ fatty alcohols having 1 to 4 EO, are also suitable. Suitable alkyl ether sulfates are, for example, compounds of formula A-1

$$R^1\text{—O-(AO)}_n\text{—SO}_3^-X^+ \qquad \text{(A-1)}$$

In this formula $R^1$ represents a linear or branched, substituted or unsubstituted alkyl functional group, preferably a linear, unsubstituted alkyl functional group, particularly preferably a fatty alcohol functional group. Preferred functional groups R are selected from decyl, undecyl, dodecyl, tridecyl, tetradecyl, pentadecyl, hexadecyl, heptadecyl, octadecyl, nonadecyl, eicosyl functional groups and mixtures thereof, the representatives which have an even number of C atoms being preferred. Particularly preferred functional groups $R^1$ are derived from $C_{12}$-$C_{18}$ fatty alcohols, for example from coconut fatty alcohol, tallow fatty alcohol, lauryl alcohol, myristyl alcohol, cetyl alcohol or stearyl alcohol or from $C_{10}$-$C_{20}$ oxo alcohols. AO represents an ethylene oxide (EO) group or propylene oxide (PO) group, preferably an ethylene oxide group. The index n represents an integer from 1 to 50, preferably from 1 to 20, and in particular from 2 to 10. More particularly preferably, n represents the numbers 2, 3, 4, 5, 6, 7 or 8. X represents a monovalent cation or the n-th part of an n-valent cation, in this case the alkali metal ions, which include $Na^+$ or $K^+$, being preferred, $Na^+$ being most preferred. Further cations $X^+$ can be selected from $NH_4^+$, ½ $Mg^{2+}$, ½ $Ca^{2+}$, ½ $Mn^{2+}$, and mixtures thereof.

In different embodiments the alkylether sulfate can be selected from fatty alcohol ether sulfates of formula A-2.

(formula A-2)

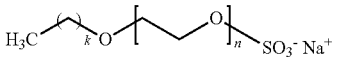

where k=11 to 19, and n=2, 3, 4, 5, 6, 7 or 8.

More particularly preferred representatives are Na—$C_{12-14}$ fatty alcohol ether sulfates having 2 EO (k=11-13, n=2 in formula A-2). The degree of ethoxylation indicated represents a statistical average that can correspond to an integer or a fractional number for a specific product. The degrees of alkoxylation indicated represent statistical averages that can correspond to an integer or a fractional number for a specific product. Preferred alkoxylates/ethoxylates have a narrowed homolog distribution (narrow range ethoxylates, NRE).

Within the meaning of the present invention, the term "anionic surfactant" is understood not to mean soaps. Although the washing or cleaning agents according to the invention may comprise soaps, these are not classified as anionic surfactants within the meaning of the present invention.

Accordingly, soaps are considered additional components of the washing or cleaning agents. Saturated fatty acid soaps are suitable, such as the salts of lauric acid, myristic acid, palmitic acid, stearic acid, hydrogenated erucic acid and behenic acid, and in particular soap mixtures derived from natural fatty acids, such as coconut fatty acids, palm kernel fatty acids or tallow fatty acids. The anionic surfactants, as well as soaps, can be present in the form of the sodium, potassium or ammonium salts thereof, and as soluble salts of organic bases, such as monoethanolamine, diethanolamine or triethanolamine. The anionic surfactants and soaps are preferably present in the form of the sodium, potassium or magnesium salts thereof, in particular in the form of the sodium salts.

There are no general conditions that must be adhered to that would stand in the way of having a degree of freedom in terms of the formulation when selecting the anionic surfactants. It is only important to bear in mind that soaps should not be classified as anionic surfactants. Anionic surfactants that are preferably used are in this case the alkylbenzene sulfonates and fatty alcohol sulfates, in particular the alkylbenzene sulfonates.

If the washing or cleaning agent comprises one or more soaps, the proportion of soap is preferably from 0.1 to 1 wt. %, in particular from 0.1 to 0.7 wt. % or from 0.2 to 0.5 wt. %, based on the total weight of the washing or cleaning agent.

Unless otherwise indicated, all amounts indicated in connection with the washing or cleaning agents described herein refer to wt. %, in each case based on the total weight of the washing or cleaning agent. Moreover, amounts that relate to at least one component always relate to the total amount of this type of component contained in the agent, unless explicitly indicated otherwise. This means that specified amounts of this type, for example in connection with "at least one anionic surfactant," refer to the total amount of anionic surfactants contained in the agent.

The amounts specified in conjunction with the washing or cleaning agents according to the invention likewise apply to the method and uses according to the invention.

In addition to the described anionic surfactants and short-chain alkyl amido propyl betaines, the washing or cleaning agents may also contain further conventional ingredients of agents of this kind. In this regard, primarily further surfactants, in particular non-ionic surfactants, builder substances, bleaching agents, enzymes and other active substances should be mentioned. Very generally, the washing or cleaning agent may contain further ingredients which further improve the practical and/or aesthetic properties of the washing agent. Within the scope of the present invention, the washing or cleaning agent preferably additionally contains one or more substances from the group comprising enzymes, bleaching agents, bleach activators, complexing agents, builders, electrolytes, non-aqueous solvents, pH adjusters, perfumes, perfume carriers, fluorescing agents, optical brighteners, dyes, speckles, hydrotropic substances, silicone oils, anti-redeposition agents, graying inhibitors, anti-shrink agents, anti-crease agents, dye transfer inhibitors, antimicrobial active ingredients, germicides, fungicides, antioxidants, preservatives, corrosion inhibitors, antistatic agents, bittering agents, ironing aids, repellents and impregnating agents, anti-swelling and anti-slip agents, softening components and UV absorbers. If the washing or cleaning agents according to the invention as defined herein do not comprise soaps, the compositions may nevertheless comprise speckles which comprise soap fractions. In this case, the composition only comprises soaps in the speckles.

Non-ionic surfactants that are preferably used are alkoxylated, advantageously ethoxylated, in particular primary alcohols having preferably 8 to 18 C atoms and, on average, 1 to 12 mol of ethylene oxide (EO) per mol of alcohol, in which the alcohol functional group can be linear or preferably methyl-branched in the 2 position, or can contain linear and methyl-branched functional groups in admixture, as are usually present in oxo alcohol functional groups. However, alcohol ethoxylates having linear functional groups of alcohols of native origin having 12 to 18 C atoms, for example of coconut, palm, tallow fatty or oleyl alcohol, and an average of 2 to 8 EO per mol of alcohol, are particularly preferred. Examples of preferred ethoxylated alcohols are $C_{12-14}$ alcohols having 3 EO or 4 EO, $C_{9-11}$ n-alcohols having 7 EO, $C_{13-15}$ alcohols having 3 EO, 5 EO, 7 EO or 8 EO, $C_{12-18}$ alcohols having 3 EO, 5 EO or 7 EO, and mixtures thereof, such as mixtures of $C_{12-14}$ alcohol having 3 EO and $C_{12-18}$ alcohol having 5 EO. The degrees of ethoxylation indicated represent statistical averages that can correspond to an integer or a fractional number for a specific product. Preferred alcohol ethoxylates have a narrowed homolog distribution (narrow range ethoxylates, NRE). In addition to these non-ionic surfactants, fatty alcohols having more than 12 EO can also be used. Examples of these are tallow fatty alcohols having 14 EO, 25 EO, 30 EO, or 40 EO.

Another class of non-ionic surfactants that are preferably used, which are used either as the sole non-ionic surfactant or in combination with other non-ionic surfactants, is alkoxylated, preferably ethoxylated or ethoxylated and propoxylated fatty acid alkyl esters, preferably having 1 to 4 carbon atoms in the alkyl chain, in particular fatty acid methyl esters.

Another class of non-ionic surfactants that can advantageously be used is the alkyl polyglycosides (APG). Alkyl polyglycosides that can be used have the general formula $RO(G)_z$, in which R represents a linear or branched, in particular methyl-branched at the 2-position, saturated or unsaturated aliphatic functional group having 8 to 22, preferably 12 to 18, C atoms, and G is the symbol that represents a glycose unit having 5 or 6 C atoms, preferably glucose. The degree of glycosidation z is between 1.0 and 4.0, preferably between 1.0 and 2.0, and in particular between 1.1 and 1.4. Linear alkyl polyglycosides are preferably used, which is to say alkyl polyglycosides in which the polyglycol functional group is a glucose functional group and the alkyl functional group is an n-alkyl functional group.

Non-ionic surfactants of the amine oxide type, for example N-cocoalkyl-N,N-dimethylamine oxide and N-tallow alkyl-N,N-dihydroxyethylamine oxide, and of the fatty acid alkanolamides can also be suitable. The amount of these non-ionic surfactants is preferably no more than that of the ethoxylated fatty alcohols, in particular no more than half thereof.

Builder substances are another significant group of washing or cleaning agent ingredients. This substance class is understood to cover both organic and inorganic builder substances. These are compounds which may carry out a supporting function in the agents according to the invention and also act as a water softening substance when in use.

Usable organic builder substances are, for example, the polycarboxylic acids that can be used in the form of the sodium salts thereof, polycarboxylic acids being understood to mean those carboxylic acids that carry more than one acid function. These include, for example, citric acid, adipic acid, succinic acid, glutaric acid, malic acid, tartaric acid, maleic acid, fumaric acid, saccharic acids, aminocarboxylic acids, nitrilotriacetic acid (NTA), provided that the use thereof is not objectionable for ecological reasons, and mixtures thereof. Preferred salts are the salts of polycarboxylic acids such as citric acid, adipic acid, succinic acid, glutaric acid, tartaric acid, saccharic acids, and mixtures thereof. The acids can also be used per se. In addition to the builder effect, the acids typically also have the property of being an acidification component and are thus also used, for example in the granules according to the invention, for setting a lower and milder pH of washing or cleaning agents. Particularly noteworthy here are citric acid, succinic acid, glutaric acid, adipic acid, gluconic acid, and any mixtures thereof.

Polymeric polycarboxylates are also suitable as builders. These are, for example, the alkali metal salts of polyacrylic acid or polymethacrylic acid, for example those having a relative molecular mass of from 500 to 70,000 g/mol. This substance class has already been described in detail above. The (co)polymeric polycarboxylates may be used either as a powder or an aqueous solution. The content of (co)polymeric polycarboxylates in the agent is preferably from 0.5 to 20 wt. %, in particular from 3 to 10 wt. %.

To improve water solubility, the polymers can also contain allyl sulfonic acids, such as allyloxybenzene sulfonic acid and methallyl sulfonic acid in EP-B-0 727 448, as a monomer. Biodegradable polymers composed of more than two different monomer units are also particularly preferred, for example those that, according to DE-A-43 00 772, contain salts of acrylic acid and of maleic acid, and vinyl alcohol or vinyl alcohol derivatives as monomers or, according to DE-C-42 21 381, salts of acrylic acid and of 2-alkylallylsulfonic acid and sugar derivatives as monomers. Further preferred copolymers are those that are described in the German patent applications DE-A-43 03 320 and DE-A-44 17 734 and preferably comprise acrolein and acrylic acid/acrylic acid salts or acrolein and vinyl acetate as monomers. Polymeric aminodicarboxylic acids, the salts thereof or the precursors thereof should likewise be mentioned as further preferred builders. Polyaspartic acids or the salts and derivatives thereof are particularly preferred, of which it is disclosed in the German patent application DE-A-195 40 086 that they also exhibit a bleach-stabilizing effect, in addition to co-builder properties.

Additional suitable builders are polyacetals, which may be obtained by reacting dialdehydes with polyolcarboxylic acids which have 5 to 7 C atoms and at least 3 hydroxyl groups, for example as described in the European patent application EP-A-0 280 223. Preferred polyacetals are obtained from dialdehydes such as glyoxal, glutaraldehyde, terephthalaldehyde and mixtures thereof, and from polyol carboxylic acids such as gluconic acid and/or glucoheptonic acid.

Further suitable organic builders are dextrins, for example oligomers or polymers of carbohydrates, which can be obtained by the partial hydrolysis of starches. The hydrolysis can be carried out according to customary, for example acid- or enzyme-catalyzed, methods. These dextrins are preferably hydrolysis products having an average molar mass in the range of from 400 to 500,000 g/mol. In this case, a polysaccharide having a dextrose equivalent (DE) in the range of from 0.5 to 40, in particular from 2 to 30, is preferred, DE being a customary measure for the reducing effect of a polysaccharide compared to dextrose, which has a DE of 100. It is possible to use both maltodextrins having a DE between 3 and 20 and dried glycose syrups having a DE between 20 and 37, and what are known as yellow dextrins and white dextrins having higher molar masses in the range of from 2,000 to 30,000 g/mol. A preferred dextrin is described in the British patent application 94 19 091. Oxidized derivatives of dextrins of this type are the reaction products thereof with oxidizing agents which are capable of oxidizing at least one alcohol function of the saccharide ring to form a carboxylic acid function. Oxidized dextrins of this kind and methods for the preparation thereof are known, for example, from the European patent applications EP-A-0 232 202, EP-A-0 427 349, EP-A-0 472 042 and EP-A-0 542 496, and the international patent applications WO 92/18542, WO-A-93/08251, WO-A-93/16110, WO-A-94/28030, WO-A-95/07303, WO-A-95/12619 and WO-A-95/20608. An oxidized oligosaccharide according to the German patent application DE-A-196 00 018 is also suitable. A product that is oxidized on $C_6$ of the saccharide ring can be particularly advantageous.

Oxydisuccinates and other derivatives of disuccinates, preferably ethylenediamine disuccinate, are further suitable cobuilders. Ethylenediamine-N,N'-disuccinate (EDDS), the synthesis of which is described in U.S. Pat. No. 3,158,615, for example, is preferably used in the form of the sodium or magnesium salts thereof. Glycerol disuccinates and glycerol trisuccinates, as described for example in the US patent specifications U.S. Pat. Nos. 4,524,009, 4,639,325, in the European patent application EP-A-0 150 930 and in the Japanese patent application JP H05339896, are also furthermore preferred in this context. Suitable amounts for use in zeolite-containing and/or silicate-containing formulations are from 3 to 15 wt. %.

Further organic cobuilders that can be used are, for example, acetylated hydroxycarboxylic acids or the salts thereof, which optionally can also be present in lactone form and comprise at least 4 carbon atoms and at least one hydroxy group, as well as no more than two acid groups. Cobuilders of this kind are described, for example, in the international patent application WO-A-95/20029.

A further class of substances having cobuilder properties is phosphonates. These include, in particular, hydroxyalkane and aminoalkane phosphonates. Of the hydroxyalkane phosphonates, 1-hydroxyethane-1,1-diphosphonate (HEDP) is of particular importance as a cobuilder. It is preferably used as a sodium salt, the disodium salt reacting neutral and the tetrasodium salt reacting alkaline (pH 9). Possible preferable aminoalkane phosphonates include ethylenediamine tetramethylene phosphonate (EDTMP), diethylentriamine pentamethylene phosphonate (DTPMP) and the higher homologs thereof. They are preferably used in the form of the neutrally reacting sodium salts, for example as the hexasodium salt of EDTMP or as the hepta- and octa-sodium salt of DTPMP. Of the class of phosphonates, HEDP is preferably used as a builder. The aminoalkane phosphonates additionally have a pronounced heavy-metal-binding power. Accordingly, it may be preferred, in particular if the agents also include bleach, to use aminoalkane phosphonates, in particular DTPMP, or to use mixtures of the mentioned phosphonates. Moreover, all compounds that are able to form complexes with alkaline earth ions can be used as cobuilders.

A preferably used inorganic builder is finely crystalline, synthetic and bound-water-containing zeolite. The finely crystalline, synthetic and bound-water-containing zeolite used is preferably zeolite A and/or P. Zeolite X and mixtures of A, X and/or P, for example a co-crystallizate from zeolites A and X are also suitable, however. The zeolite can be used as a spray-dried powder or also as an undried, stabilized suspension that is still moist from its preparation process. If zeolite is used in the form of a suspension, it may contain small additional amounts of non-ionic surfactants as stabilizers, for example from 1 to 3 wt. %, based on the zeolite, of ethoxylated $C_{12}$-$C_{18}$ fatty alcohols having 2 to 5 ethylene oxide groups, $C_{12}$-$C_{14}$ fatty alcohols having 4 to 5 ethylene oxide groups or ethoxylated isotridecanols. Suitable zeolites have an average particle size of less than 10 μm (volume distribution; measuring method: Coulter counter) and preferably contain from 18 to 22 wt. %, and in particular from 20 to 22 wt. %, of bound water. In preferred embodiments, zeolites are contained in the premix in amounts of from 10 to 94.5 wt. %, it being particularly preferable for zeolite to be contained in amounts of from 20 to 70 wt. %, in particular from 30 to 60 wt. %.

Suitable partial substitutes for zeolites are phyllosilicates of natural and synthetic origin. Phyllosilicates of this kind are known from patent applications DE-A-23 34 899, EP-A-0 026 529 and DE-A-35 26 405, for example. The usability thereof is not limited to a specific composition or structural formula. However, smectites are preferred, in particular bentonites. Crystalline, layered sodium silicates of the general formula $NaMSi_xO_{2x+1}yH_2O$, where M is sodium or hydrogen, x is a number from 1.9 to 4 and y is a number from 0 to 20, and preferred values for x are 2, 3 or 4, are also suitable as zeolite or phosphate substitutes. Crystalline phyllosilicates of this kind are described, for example, in European patent application EP-A-0 164 514. Preferred crystalline phyllosilicates of the aforementioned formula are those in which M represents sodium and x assumes the values 2 or 3. Both ß- and δ-sodium disilicates $Na_2Si_2O_5yH_2O$ are particularly preferred.

The preferred builders can also include amorphous sodium silicates which have a $Na_2O:SiO_2$ modulus of from 1:2 to 1:3.3, preferably from 1:2 to 1:2.8, and in particular from 1:2 to 1:2.6, and preferably have retarded dissolution and secondary washing properties. The retarded dissolution compared to conventional amorphous sodium silicates can have been caused in a variety of ways, for example by way of surface treatment, compounding, compacting/compression or over-drying. Within the scope of the present invention, the term "amorphous" is also understood to mean "X-ray amorphous." This means that the silicates do not supply any sharp X-ray reflexes in X-ray diffraction experiments, such as those that are typical of crystalline substances, but at best one or more maxima of the scattered X-rays, which have a width of several degree units of the diffraction angle. However, particularly good builder properties may very well also be achieved when the silicate particles supply washed-out or even sharp diffraction maxima in electron diffraction experiments. This is to be interpreted such that the products comprise microcrystalline regions measuring 10 to several hundred nm, values up to a maximum of 50 nm, and in particular up to a maximum of 20 nm, being preferred. "X-ray amorphous silicates" of this kind, which likewise exhibit retarded dissolution compared with conventional water glasses, are described in the German patent application DE-A-44 00 024, for example. In particular, compressed/compacted amorphous silicates, compounded amorphous silicates and overdried X-ray amorphous silicates are preferred, in particular the overdried silicates preferably also occurring as carriers in the granules according to the invention or being used as carriers in the method according to the invention.

Further suitable inorganic builders are carbonates, in particular sodium carbonate.

It is self-evidently also possible to use the generally known phosphates as builders, provided that the use thereof should not be avoided for ecological reasons. Sodium salts of orthophosphates, pyrophosphates and in particular tripolyphosphates are particularly suitable. The content thereof is generally no more than 25 wt. %, preferably no more than 20 wt. %, in each case based on the finished agent. In some cases it has been shown that, in particular, tripolyphosphates even in small amounts up to a maximum of 10 wt. %, based on the finished agent, in combination with other builders result in a synergistic improvement of the secondary washing performance. The washing or cleaning agent is preferably free of phosphates.

The washing or cleaning agent may also contain at least one enzyme. In principle, all the enzymes found in the prior art for this purpose can be used in this regard. This at least one enzyme is preferably one or more enzymes which can develop catalytic activity in a washing or cleaning agent, in particular a protease, amylase, lipase, cellulase, hemicellulase, mannanase, pectin-cleaving enzyme, tannase, xylanase, xanthanase, ß-glucosidase, carrageenanase, perhydrolase, oxidase, oxidoreductase and mixtures thereof. Preferred hydrolytic enzymes include in particular proteases, amylases, in particular α-amylases, cellulases, lipases, hemicellulases, in particular pectinases, mannanases, ß-glucanases, and mixtures thereof. Proteases, amylases and/or lipases and mixtures thereof are particularly preferred, and proteases are more particularly preferred. In principle, these enzymes are of natural origin; starting from the natural molecules, improved variants for use in washing or cleaning agents are available which are correspondingly preferably used.

The enzymes to be used can also be formulated together with accompanying substances, for example from fermentation, or with stabilizers.

All substances which destroy or absorb dyes by means of oxidation, reduction or adsorption, and thus decolorize materials, can be used as bleaching agents. These include, inter alia, hypohalite-containing bleaching agents, hydrogen peroxide, perborate, percarbonate, peracetic acid, diperoxyazelaic acid, diperoxy dodecanedioic acid and oxidative enzyme systems. In addition to the aforementioned components, the washing or cleaning agents according to the invention can additionally contain one or more of the abovementioned substances, in particular those from the group comprising bleach activators, pH adjusters, perfumes, perfume carriers, fluorescing agents, dyes, silicone oils, anti-redeposition agents, optical brighteners, graying inhibitors and dye transfer inhibitors. Suitable agents are known in the prior art.

This list of washing or cleaning agent ingredients is by no means exhaustive, but merely reflects the most essential typical ingredients of agents of this kind.

In the washing or cleaning method described, in particular washing method, temperatures of up to 95° C. or less, 90° C. or less, 60° C. or less, 50° C. or less, 40° C. or less, 30° C. or less or 20° C. or less are used in different embodiments of the invention. These specified temperatures relate to the temperatures used in the washing or cleaning steps.

In a preferred embodiment, the method according to the invention therefore also comprises the step of dosing one or more auxiliaries into the surfactant-containing liquid flow. These auxiliaries can be dosed into the surfactant-containing liquid flow before or after the dye solution has been dosed. The auxiliary or auxiliaries are preferably dosed into the surfactant-containing liquid flow before the dye solution, such that the dye solution is dosed into the surfactant-containing liquid flow as late as possible in relation to the entire preparation method. This has the advantage that only the smallest possible part of the facility comes into contact with the dye. If a change of color is desired, only a small part of the facility has to be cleaned.

According to the invention, it is certainly possible for some of the auxiliaries to be dosed before the dye solution, and for some of the auxiliaries, such as in particular enzymes or fragrances, to be dosed after the dye solution.

Washing or cleaning agents according to the invention which are obtained by means of the above-described method are a further aspect of the present invention. These washing or cleaning agents are thus free from preservatives, without this however impairing the visual properties or microbial impurities in any way.

A further aspect of the present invention is providing a preservative-free dye solution. In this case, the dye is first predissolved in water in a low concentration, and the premixture obtained in this way is subsequently diluted in a non-aqueous organic solvent, the content of the organic solvent being at least 70 wt. % based on the total weight of the dye solution. The content of organic solvent is preferably 80 wt. %, in particular 90 wt. % or more.

The organic solvent is a non-aqueous solvent. Preferred non-aqueous solvents include monovalent or polyvalent alcohols, alkanol amines or glycol ethers. The solvents are preferably selected from ethanol, n-propanol, i-propanol, butanols, glycol, propanediol, butanediol, methylpropanediol, glycerol, diglycol, propyl diglycol, butyl diglycol, hexylene glycol, diethylene glycol ethyl ether, diethylene glycol methyl ether, diethylene glycol-n-butylether, diethylene glycol hexyl ether, diethylene glycol-n-butylether acetate, ethylene glycol propyl ether, ethylene glycol-n-butylether, ethylene glycol hexyl ether, ethylene glycol-n-butylether acetate, triethylene glycol methyl ether, triethylene glycol ethyl ether, triethylene glycol-n-butylether, ethylene glycol phenyl ether, propylene glycol methyl ether, dipropylene glycol methyl ether, tripropylene glycol methyl ether, propylene glycol methyl ether acetate, dipropylene glycol methyl ether acetate, propylene glycol-n-propyl ether, dipropylene glycol-n-propyl ether, propylene glycol-n-butylether, dipropylene glycol-n-butylether, tripropylene glycol-n-butylether, propylene glycol phenyl ether, propylene glycol diacetate, dipropylene glycol dimethyl ether, methoxytriglycol, ethoxytriglycol, butoxytriglycol, 1-butoxyethoxy-2-propanol, 3-methyl-3-methoxybutanol, propylene-glycol-t-butylether, di-n-octylether (1,2-propanediol) and mixtures of these solvents. In this case, 1,2-propylene glycol is preferred, since it is particularly readily miscible with water and also does not disadvantageously react with the other components of a washing or cleaning agent.

In the following embodiments, the present invention is explained in a non-limiting manner:

Embodiment 1

A mixture of the two dyes Liquitintx Violet 129 and Liquitintx Pink PV, from the company Milliken Chemical, Spartanburg, S.C., USA, was prepared. In so doing, the dyes were first dissolved in water.

Composition:

| | |
|---|---|
| Liquitint ® Violet 129 | 7.63% |
| Liquitint ® Pink PV | 1.1% |
| Water | 9.13% |
| 1,2-propanediol | 82.14% |

The obtained mixture was added to a masterbatch consisting of surfactants. After the remainder of the ingredients were subsequently added, a magenta-colored final product was obtained that complies with specifications.

Embodiment 2

A mixture of the two dyes Liquitint® Cyan 15, from the company Milliken Chemical, and Sanolin Tartrazine X90, from the company Clariant, Frankfurt, Germany, was prepared for a green-colored final product. In so doing, the dyes were first dissolved in water.

Composition:

| | |
|---|---|
| Liquitint ® Cyan 15 | 2.11% |
| Sanolin Tartrazine X90 | 0.67% |
| Water | 9.72% |
| 1,2-propanediol | 87.5% |

The obtained mixture was added to a masterbatch consisting of surfactants and further active substances and auxiliaries, inter alia, from the group of solvents, optical brighteners and complexing agents. After the remainder of the ingredients were subsequently added, a final product was obtained that complies with specifications.

The dye mixture proved to be stable in a microbial load test. It was not necessary to add preservatives.

What is claimed is:

1. A continuous method for preparing a liquid washing or cleaning agent comprising at least one surfactant and at least one dye, wherein the method comprises the following steps:

a) providing a dye solution, wherein the dye is first dissolved in water and this premixture is subsequently diluted in at least one non-aqueous organic solvent, wherein the content of the organic solvent is at least 80 wt. % based on the total weight of the dye solution, and wherein no further preservative is added, b) dosing the dye solution obtained in this way into a surfactant-containing liquid flow.

2. The method according to claim 1, further comprising
c) mixing the dye solution with the surfactant-containing liquid flow by means of a dynamic or static mixer.

3. The method according to claim 1, characterized in that the dye is selected from the group of water-soluble dyes.

4. The method according to claim 3, characterized in that the dye is selected from the group of water-soluble polymer dyes.

5. The method according to claim 1, characterized in that the concentration of the dye in the aqueous premixture corresponds to at least 400 time the target concentration of dye desired in the end product.

6. The method according to claim 5, characterized in that the concentration of the dye in the aqueous premixture corresponds to at least 600 times the target concentration of dye desired in the end product.

7. The method according to claim 5, characterized in that the concentration of the dye in the aqueous premixture corresponds to at least 800 times the target concentration of dye desired in the end product.

8. The method according to claim 5, characterized in that the concentration of the dye in the aqueous premixture corresponds to at least 5,000 times the target concentration of dye desired in the end product.

9. The method according to claim 5, characterized in that the concentration of the dye in the aqueous premixture corresponds to at least 900 times to 2,000 times the target concentration of dye desired in the end product.

10. The method according to claim 1, characterized in that one or more auxiliaries are also dosed into the surfactant-containing liquid flow.

11. The method according to claim 10, characterized in that the at least one auxiliary is dosed before or at the same time as the dye solution is dosed.

12. The method according to claim 10, characterized in that the auxiliary is selected from enzymes, stabilizers, pH adjusters, fragrances, builders, rheology modifiers and mixtures thereof.

13. The method according to claim 1, characterized in that the content of organic solvent in the dye solution is 90 wt. % or more.

* * * * *